United States Patent [19]

Alessio

[11] 4,278,243

[45] Jul. 14, 1981

[54] FOLDABLE WORKBENCH

[75] Inventor: Lorenzo E. Alessio, Cairoli, Italy

[73] Assignee: Black & Decker Inc., Newark, Del.

[21] Appl. No.: 18,384

[22] Filed: Mar. 7, 1979

Related U.S. Application Data

[62] Division of Ser. No. 765,296, Feb. 3, 1977, Pat. No. 4,155,386.

[30] Foreign Application Priority Data

Feb. 19, 1976 [IT] Italy ..... 20341 A/76

[51] Int. Cl.[3] ..... B25B 1/10

[52] U.S. Cl. ..... 269/16; 269/139; 269/220; 269/244; 269/283; 269/901

[58] Field of Search ..... 108/121, 123, 115; 144/285, 286 R, 286 A, 287, 288 R, 288 C; 269/321 CF, 139, 16, 244, 219–221, 283; 182/175–176, 153, 156

[56] References Cited

U.S. PATENT DOCUMENTS

| | | | |
|---|---|---|---|
| 2,207,923 | 7/1940 | Kelso | 182/156 |
| 2,637,358 | 5/1953 | Larson | 144/286 R |
| 4,076,229 | 2/1978 | Hickman | 269/139 |

FOREIGN PATENT DOCUMENTS

| | | | |
|---|---|---|---|
| 1111118 | 7/1961 | Fed. Rep. of Germany . | |
| 1287657 | 3/1961 | France . | |
| 543179 | 5/1956 | Italy | 108/123 |

*Primary Examiner*—Robert C. Watson

*Attorney, Agent, or Firm*—Walter Ottesen; Leonard Bloom; Edward D. Murphy

[57] ABSTRACT

The invention is directed to a foldable, portable workbench having a work table and a support structure for supporting the work table. The support structure includes a pair of mutually spaced leg assemblies and each of these leg assemblies, in turn, includes a pair of legs pivotally connected at one end thereof to the work table. Articulated linkages pivotally interconnect, respectively, the two legs of each pair of legs to each other and at least one of the legs to the work table. The articulating linkages are connected so that the work table and leg structures are stacked in juxtaposition to each other when the workbench is in its folded position and, so that the other ends of the leg structures are spread apart from each other with the work table substantially transverse to the leg structures when the workbench is in the erected position.

17 Claims, 7 Drawing Figures

FOLDABLE WORKBENCH

This is a division of application Ser. No. 765,296, filed on Feb. 3, 1977 which issued as U.S. Pat. 4,155,386 on May 22, 1979.

BACKGROUND OF THE INVENTION

The invention relates to foldable workbenches. More specifically, the invention is directed to a foldable workbench which is portable and can be erected and collapsed by a simple one step motion of the operator.

There have been portable foldable workbenches suggested before which require a certain expertise of the operator when assembling the workbench for use because he must attach the legs individually and is often required to add additional supporting structure. This assembly is a laborious effort and storage of the disassembled workbench often requires considerable storage space. Yet other workbenches have been suggested as, for example, the workbench in U.S. Pat. No. 1,688,533 wherein there is disclosed a workbench having legs which translate with the aid of pivotally mounted parallel struts. However, here the table top must first be disconnected and rotated before the workbench can be stacked into a flat package.

Accordingly, it is an object of my invention to provide a workbench which is easily assembled by the operator and which takes up a minimum of storage space when not in use.

It is another object of my invention to provide a foldable workbench equipped with a work table top provided with an integral clamping vise which can be opened and closed with a simple one step movement by the operator.

It is a further object of my invention to provide such a workbench which when closed, is collapsed into a flat package that is easily portable and convenient to store.

It is still another object of my invention to provide such device which is simple and economic to produce and wherein the work table top is braced with respect to the leg structure of the workbench.

SUMMARY OF THE INVENTION

The foldable, portable workbench according to my invention includes as a feature a work table and a support structure for supporting the work table. The support structure includes a pair of mutually spaced leg asemblies and each of these leg assemblies includes at least two legs pivotally connected to the work table. Articulating means in the form of articulating linkages pivotally interconnect, respectively, the pair of legs of each leg assembly to each other and at least one of the legs to the work table. The articulating linkages are connected so that the work table and leg structures are stacked in juxtaposition to each other when the workbench is in its folded position and, so that the other ends of the legs are spread apart from each other with the work table substantially transverse to the leg structures when the workbench is in its erected position.

The workbench according to the invention is especially advantageous when the work table top is equipped with an integral clamping vise. A clamping vise of this general type is disclosed, for example, in U.S. Pat. No. 3,615,087.

According to another feature of my invention, I provide bracing means for bracing the work table top with respect to at least one of the legs while at the same time limiting the spread of the legs to a predetermined distance. The bracing means can include structure means extending from one of the linkage arms and configured for engaging one of the legs in the erected position thereby limiting the spread of the legs to the predetermined distance.

According to still another feature of the invention, I provide a tool tray extending between corresponding ones of the articulating linkages of the leg assemblies.

As another feature of the workbench according to my invention, I provide a step tread extending from a leg of one of the leg assemblies to a leg of the other one of the leg assemblies. The step tread is pivotally connected between the last mentioned legs of the leg assemblies. At least one of the leg assemblies includes an ancillary linkage arm pivotally connected to the step tread and pivotally connected into the set of articulated linkages so that the step tread is pivoted into a position flat with the last-mentioned legs when the workbench is in its folded position and, so that the step tread is pivoted into a substantially horizontal position transverse to the last-mentioned legs when the workbench is in its erected position.

The foregoing objects and advantages of my invention will become more apparent from a consideration of the detailed description to follow taken in conjunction with the drawing annexed hereto.

DESCRIPTION OF THE PREFERRED EMBODIMENTS OF THE INVENTION

Figure 1:
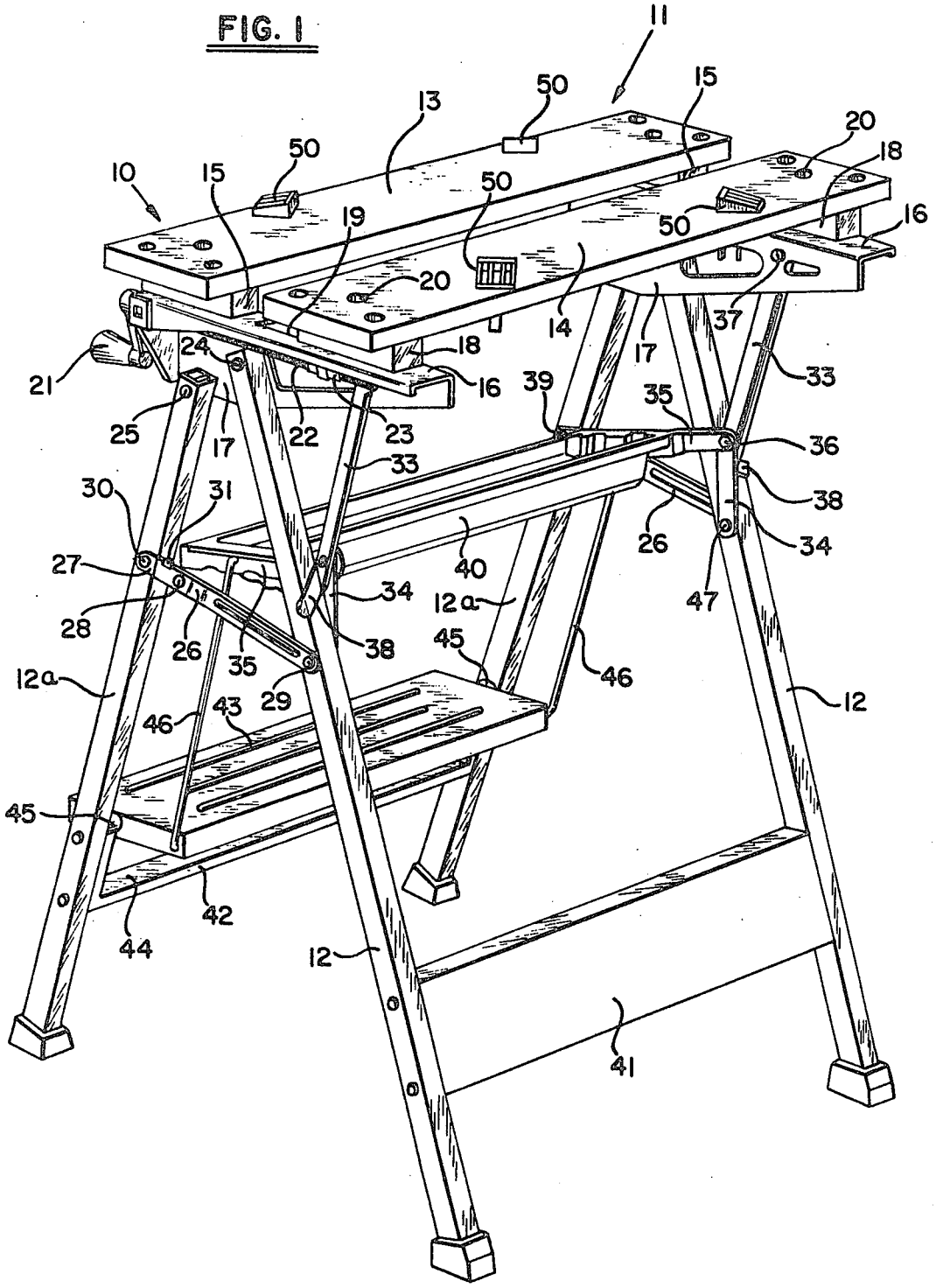
FIG. 1 is a perspective view of the workbench according to the invention equipped with a tool tray.

Reference numeral 10 indicates the flat part of the operating bench formed by two wood bench boards 13, 14 defining a work plane 11. The bench boards 13 and 14 are mounted on two mutually space leg assemblies, each leg assembly having a pair of legs 12, 12*a*.

The bench board 14 can be moved with respect to the bench board 13. Bench board 13 is stationary and is bolted to lateral supports 15 that are in turn bolted to surface 16 of respective elongated members in the form of channel brackets 17 disposed transversely to the bench boards.

Bench board 14 is movable and for this purpose is mounted on slider blocks 18 slideably mounted on rails 19 formed in the top 16 of the same channel brackets 17. The connection between bench board 14 and each slider block 18 is achieved with a pivot 20 that allows for the rotation of the bench board 14 on the slider blocks 18 when these blocks are moved forward and not mutually aligned.

More specifically, when the bench board 14 is moved so as to be at an angle with respect to bench board 13, the pivots 20 permit the bench board 14 to rotate with respect to slider blocks 18, respectively.

Figure 2:
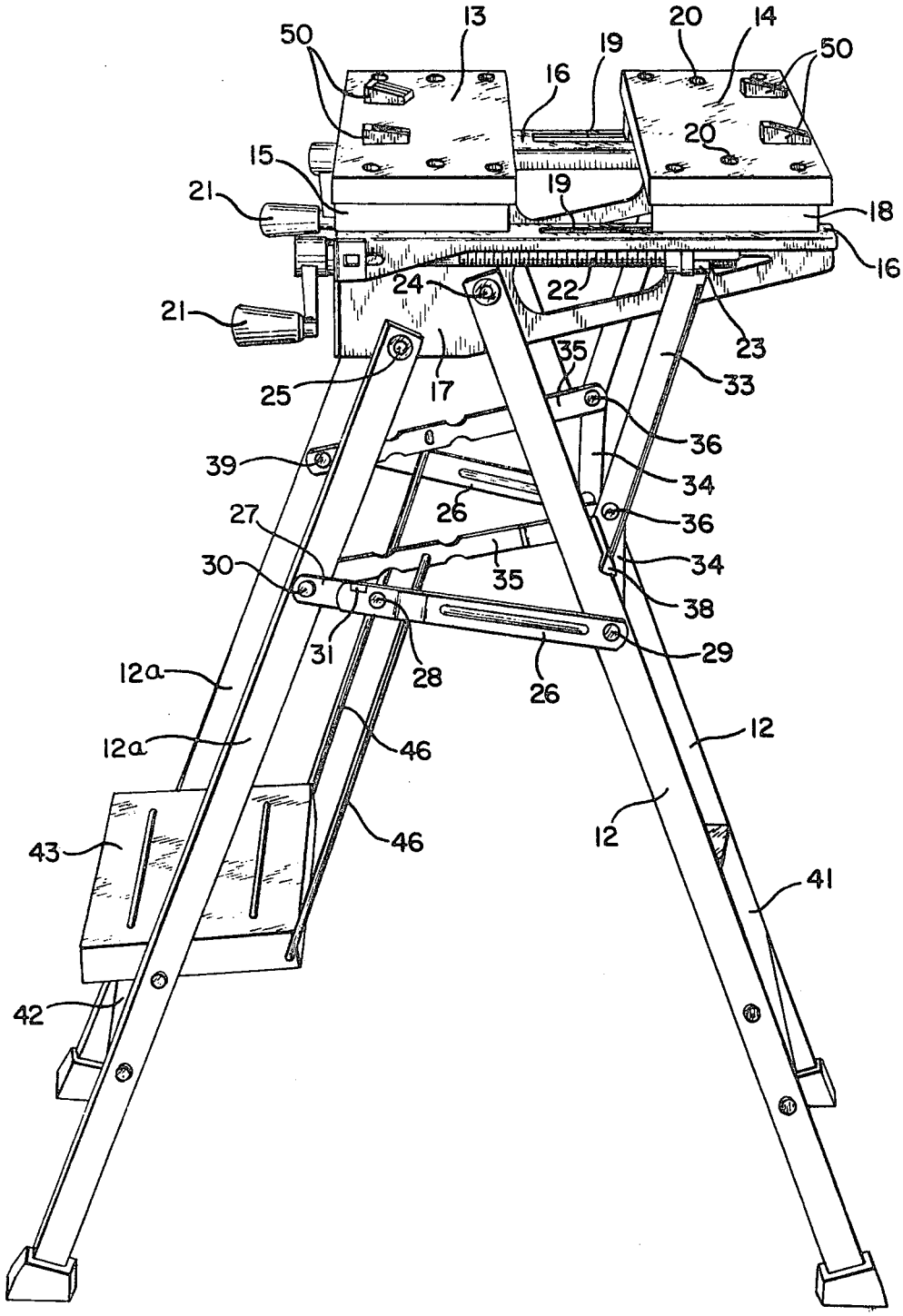
FIG. 2 is a side perspective view of the workbench of FIG. 1 showing the workbench in the erected position.

The movement of the slider blocks 18 can be controlled independently by handles 21. Each handle 21 is connected to a threaded rod 22 which is rotated by turning the handle. The rod 22 threadably engages a nut 23 fastened to the slider block 18 as illustrated in FIGS. 1 and 2. Bench boards 13 and 14 can be used conjointly as a plane of support while they also serve advantageously as jaws for tightly holding the workpiece to be worked upon. The two bench boards 13 and 14 are perforated and plugs 50 can be used to hold the workpiece even when it is larger in dimension than the vise opening between bench boards 13 and 14 with bench board 14 at its outermost limit.

Each of legs 12*a*, 12 of each leg assembly are pivotally connected to the corresponding channel bracket 17 as indicated by reference numerals 25 and 24, respectively. The legs 12*a*, 12 are mutually connected at their outer respective bides by connected links 26, 27 which are, in turn, pivotally connected to each other at pivot connection 28. The links 26 and 27 are also pivotally connected to the supports 12, 12*a* by pivot pin 29 and 30, respectively.

At the extreme end of link 26 away from pivot 29, there is also a prong 31 which engages and holds in a notch 32 (FIG. 3) of the link 27 to firmly block the links 26 and 27 when the workbench is in the open position as shown in FIGS. 1 and 2. In this way, the supporting legs 12, 12*a* can not spread apart when the bench is in use.

Each of the channel brackets 17 also is pivotally connected to the legs 12, 12*a* of a corresponding leg assembly by articulating means in the form of three linkage arms 33, 34, 35. Linkage arms 34 and 35 are connected to legs 12 and 12*a* by pivot pins 47 and 39, respectively. These linkage arms are pivotally connected to each other at pivot connection 36. The connecting arm 33 is also pivotally connected to bracket 17 at pivot 37 and is provided with a tab 38 next to the pivot 36.

The tab 38 engages leg 12 when the workbench is in the erected position to enable the arm 33 to brace the table top with respect to the leg 12. When the table is erected, the tab 38 also limits the leg 12 from spreading any further away from leg 12*a* than a predetermined distance thereby augmenting the links 26 and 27 discussed above. It should be noted that the links 26 and 27 are not entirely a duplication of function because, in addition to also limiting this spread between legs 12 and 12*a* in the erected position, links 26 and 27 impart to the bench legs a certain rigidity when the user of the bench lifts the erected bench to place it say in an other part of the work area where the bench is in use. More specifically, in the erected position, the legs 12 and 12*a* are held apart by links 26 and 27 even when the bench is lifted when the prong 31 engages the notch 32.

The linkage arms 33, 34 and 35 coact with each other and the legs 12, 12*a* as well as with bracket 17 to articulate the movement of these members when the user erects or collapses the bench. The articulated movement of the members is shown sequentially in the views FIGS. 3A to 3D for bringing the workbench from the erected position where tab 38 of arm 33 engages leg 12 in FIG. 3A through FIGS. 3B and 3C to the collapsed position shown in FIG. 3D. With this articulation of the pivotally connected members, the user of the bench can collapse the erected bench with single movement after disengaging the prong 31 from notch 32 of the links 26 and 27.

Figure 3A:
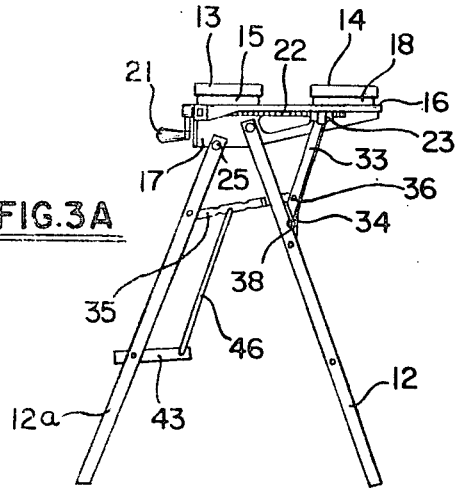
FIGS. 3A to 3D are set of sequential views showing schematically the articulating movement of the articulating linkages as the workbench is collapsed from the erected position to the closed position; and, FIG. 4 is a side perspective view of the workbench in the collapsed position.
Figure 3B:
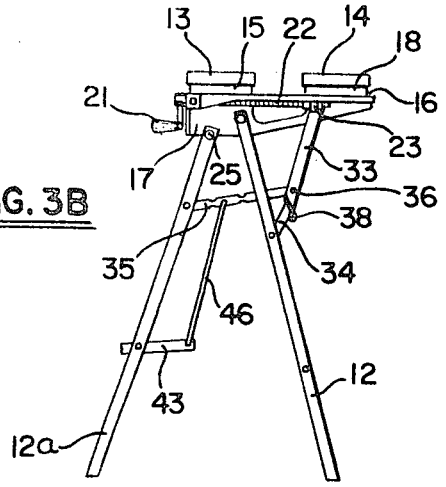
Figure 3C:
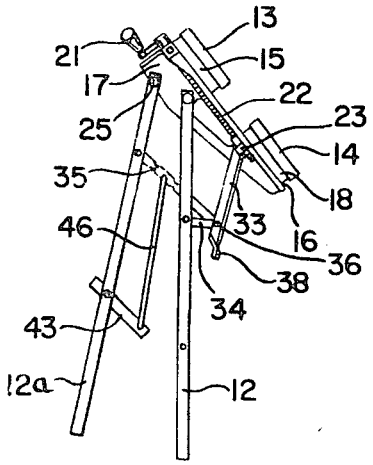
Figure 3D:
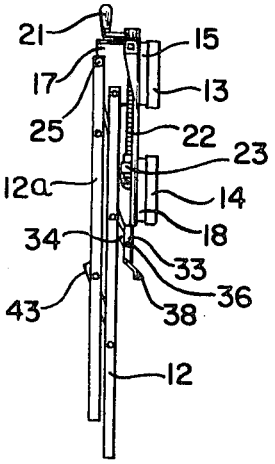
Figure 4:
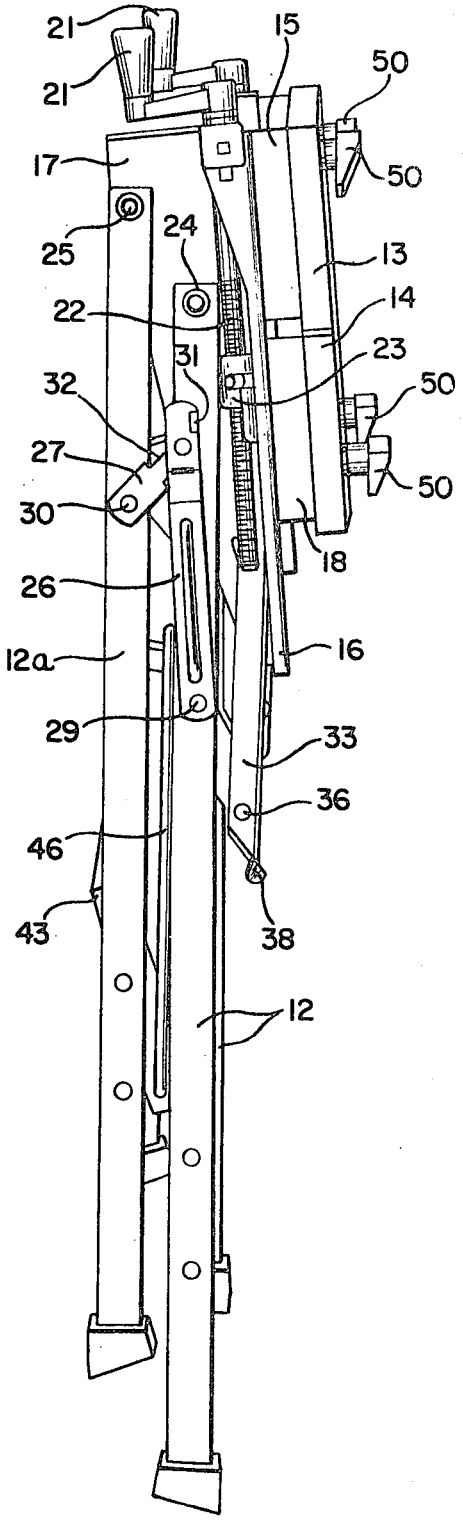

When collapsing the legs 12, 12*a*, the system of articulated linkage arms 33, 34, and 35 enables the channel brackets 17 and bench boards 13 and 14 mounted thereon to rotate until they reach a position in juxtaposition to the collapsed legs 12 and 12*a* as shown in FIGS. 3D and 4.

According to another feature of the invention, between mutually adjacent linkage arms 35 of respective leg assemblies, a tray 40 can be placed for holding work tools. For added stability, the legs 12 and legs 12*a* are mutually connected with respective cross members 41, 42 as shown in FIG. 1, the legs 12*a* and the cross member 42 conjointly define a composite structure in the form of a first H-frame; whereas, legs 12 and cross member 41 conjointly define a composite structure in the form of a second H-frame.

According to still another feature of the invention, one of the cross members 42 has a step thread 43 mounted therein. The step thread 43 is nestled in recess 42 of the cross member 42 in such a way that it can rotate about the pivot connections 45.

The step thread 43 is also connected to linkage arm 35 of the articulation means by bracing links 46. Specifically, the ends of the bracing links 46 are respectively pivotally connected to the step thread 43 and to the arm 35. When the bench is collapsed to the position shown in FIGS. 3D and 4, the step thread 43 is compelled to rotate into a position so that its flat dimension lies in the plane of legs 12*a* by the coaction of bracing links 46 and linkage arms 35.

The work bench disclosed above is a folding metal structure which is very strong and sturdy when in use and, at the same time, is made of a minimal number of very light parts which facilitate handling and movement of the bench.

I claim:

1. A foldable workbench comprising:

an integral clamping vise defining a top workbench surface; and a support structure for supporting the vise, the support structure including a pair of mutually spaced leg assemblies, each of said leg assemblies including:

first and second legs pivotally connected to said clamping vise so as to be pivotally movable from a collapsed position wherein the workbench is in a folded condition to an open position wherein said legs diverge from one another in a downward direction and the workbench is in the erected condition;

said first and second legs being pivotally connected to said clamping vise at first and second pivot axes, respectively; said first pivot axis being at a lower elevation than said second pivot axis whereby said clamping vise, said first leg, and said second leg are all juxtaposed one to the other to form a flat stack of mutually parallel elements when the workbench is in the folded condition;

articulating means pivotally connected to each of said legs and said clamping vise for coacting therewith to simultaneously articulate the movement of said legs and said clamping vise between said collapsed position wherein said legs and said clamping vise are folded to form said flat stack and said open position wherein the outer ends of said legs are spread apart a predetermined distance; and means for bracing the integral clamping vise with respect to at least one of said legs while at the same time limiting the spread of said legs to a predetermined distance;

said articulating means including:

a set of articulating linkages pivotally interconnecting, respectively, the pair of legs to each other and at least one of the legs to the integral clamping vise, said articulating linkages being connected so that the integral clamping vise and leg structures are stacked in juxtaposition to each other when the workbench is in its folded position and, so that the other ends of the legs are spread apart from each other with the integral clamping vise substantially transverse to the leg structures when the workbench is in the erected position;

said bracing means including structure means extending from one of said linkages and configured for engaging one of said legs in said erected position thereby limiting the spread of said legs to said predetermined distance.

2. The foldable workbench of claim 1, said bracing means including structure means formed on the linkage connected to said integral clamping vise and configured for engaging one of said legs in said second position to brace said integral clamping vise with respect to said one leg while at the same time limiting the spread of said legs to said predetermined distance.

3. A foldable workbench comprising:

an integral clamping vise defining a top workbench surface; and a support structure for supporting the vise, the support structure including a pair of mutually spaced leg assemblies, each of said leg assemblies including:

first and second legs pivotally connected to said clamping vise so as to be pivotally movable from a collapsed position wherein the workbench is in a folded condition to an open position wherein said legs diverge from one another in a downward direction and the workbench is in the erected condition;

said first and second legs being pivotally connected to said clamping vise at first and second pivot axes, respectively; said first pivot axis being at a lower elevation than said second pivot axis whereby said clamping vise, said first leg, and said second leg are all juxtaposed one to the other to form a flat stack of mutually parallel elements when the workbench is in the folded condition;

articulating means pivotally connected to each of said legs and said clamping vise for coacting therewith to simultaneously articulate the movement of said legs and said clamping vise between said collapsed position wherein said legs and said clamping vise are folded to form said flat stack and said open position wherein the outer ends of said legs are spread apart a predetermined distance;

said articulating means including: a set of articulating linkages pivotally interconnecting, respectively, the pair of legs to each other and at least one of the legs to the integral clamping vise, said articulating linkages being connected so that the integral clamping vise and leg structures are stacked in juxtaposition to each other when the workbench is in its folded position and, so that the other ends of the legs are spread apart from each other with the integral clamping vise substantially transverse to the leg structures when the workbench is in the erected position; and a tool tray extending between corresponding selected ones of said articulated linkages of said leg assemblies.

4. A foldable workbench comprising: an integral clamping vise and a supporting structure for supporting the integral clamping vise, the supporting structure comprising:

a pair of mutually spaced leg assemblies, each of said leg assemblies including:

a pair of legs pivotally connected at one end thereof to the integral clamping vise; and, a set of articulating linkages pivotally interconnecting, respectively, the pair of legs to each other and at least one of the legs to the integral clamping vise, said articulating linkages being connected so that the integral clamping vise and leg structures are stacked in juxtaposition to each other when the workbench is in its folded position and, so that the other end of the legs are spread apart from each other with the integral clamping vise substantially transverse to the leg structures when the workbench is in the erected position; and, a step tread extending from a leg of one of said leg assemblies to a leg of the other one of said leg assemblies, said step tread being pivotally connected between said last-mentioned legs of said leg assemblies; and at least one of said leg assemblies including an ancillary linkage arm pivotally connected to said step tread and pivotally connected into said set of articulated linkages so that the step tread is pivoted into a position flat with said last-mentioned legs when the workbench is in its folded position and, so that said step tread is pivoted into a substantially horizontal position transverse to said last-mentioned legs when the workbench is in said erected position.

5. A foldable workbench comprising:

a work table in the form of an integral clamping vise; and, a supporting structure for supporting the work table top, the supporting structure including a pair of mutually spaced leg assemblies, each of said leg assemblies including:

first and second legs pivotally connected to said work table so as to be pivotally movable from a collapsed position wherein the workbench is in a folded condition to an open position wherein said legs diverge from one another in a downward direction and the workbench is in the erected condition;

said first and second legs being pivotally connected to said work table at first and second pivot axes, respectively; said first pivot axis being at a lower elevation than said second pivot axis whereby said work table, said first leg, and said second leg are all juxtaposed one to the other to form a flat stack of mutually parallel elements when the workbench is in the folded condition;

articulating means pivotably connected to each of said legs and said work table for coacting therewith to simultaneously articulate the movement of said legs and said work table between said collapsed position wherein said legs and said work table are folded to form said flat stack and said open position wherein the outer ends of said legs are spread apart a predetermined distance;

said first leg being shorter than said second by an amount sufficient to ensure that said work table will be in a substantially horizontal position when the workbench is in said erected condition; and, said articulating means including means for fixing the spread between said legs in said open position; and, a step tread extending from a leg of one of said leg assemblies to a leg of the other one of said leg assemblies, said step tread being pivotally connected between said last-mentioned legs of said leg assemblies; and at least one of said leg assemblies including an ancillary linkage arm pivotally connected to said step tread and pivotally connected into said articulating means so that the step tread is pivoted into a position flat with said last-mentioned legs when the workbench is in its folded condition, and so that the said step tread is pivoted into a substantially horizontal position transverse to said last-mentioned legs when the workbench is in said erected condition.

6. A foldable workbench comprising:

a work table in the form of an integral clamping vise; and, a support structure for supporting said work table above the ground when the workbench is in the erected condition; the support structure including two leg assemblies supporting said work table at respective longitudinal ends thereof, each of said leg assemblies including:

first and second legs pivotally connected to said work table so as to be pivotally movable from a collapsed position wherein the workbench is in a folded condition to an open position wherein said legs diverge from one another in a downward direction and the workbench is in said erected condition;

said first and second legs being pivotally connected to said work table at first and second pivot axes, respectively; said first pivot axis being at a lower elevation than said second pivot axis whereby said work table, said first leg, and said second leg are all juxtaposed one to the other to form a flat stack of mutually parallel elements when the workbench is in the folded condition;

a linkage arrangement including three linkage arms pivotally connected to each other at respective end portions thereof to define an articulating pivot joint independent of said table, and said legs, said linkage arms also being connected at corresponding other end portions thereof to respective ones of said legs and said work table to conjointly articulate the rotational movement of said work table and said legs between said collapsed position and said open position;

said first leg being shorter than said second leg by an amount sufficient to ensure that said work table will be in a substantially horizontal position when the workbench is in said erected condition; and, said linkage arrangement including means for fixing the spread between said legs in said open position.

7. The foldable workbench of claim 6, comprising: a step tread extending from a leg of one of said leg assemblies to a leg of the other one of said leg assemblies, said step tread being pivotally connected between said last-mentioned legs of said leg assemblies; and at least one of said leg assemblies including an ancillary linkage arm pivotally connected to said step tread and pivotally connected into said linkage arrangement so that the step tread is pivoted into a position flat with said last-mentioned legs when the workbench is in its folded condition and, so that said step tread is pivoted into a substantially horizontal position transverse to said last-mentioned legs when the workbench is in said erected condition.

8. A foldable workbench comprising:

a work table in the form of an integral vise; and, a support structure for supporting said work table, the support structure including a pair of mutually spaced leg assemblies, each of said leg assemblies including:

first and second pivotally connected to said work table so as to be pivotally movable from a collapsed position wherein the workbench is in a folded condition to an open position wherein said legs diverge from one another in a downward direction and the workbench is in the erected condition;

said first and second legs being pivotally connected to said work table at first and second pivot axes, respectively; and, a linkage arrangement including three linkage arms pivotally connected to each other at respective end portions thereof to define an articulating pivot joint independent of said table and said legs, a first one and a second one of said linkage arms also being pivotally connected at corresponding other end portions thereof to respective ones of said legs, the third one of said linkage arms being pivotally connected to said table at a third pivot axis spaced from said first and second pivot axes; said linkage arms being pivotally connected to said table and said legs, respectively so as to articulate the rotational movement of said table and said legs thereby facilitating the placement of said workbench in said erected condition from said collapsed condition.

9. The foldable workbench of claim 8 comprising: a step tread extending from a leg of one of said leg assemblies to a leg of the other one of said leg assemblies, said step tread being pivotally connected between said last-mentioned legs of said leg assemblies; and at least one of said leg assemblies including an ancillary linkage arm pivotally connected to said step tread and pivotally connected into said linkage arrangement so that the step tread is pivoted into a position flat with said last-mentioned legs when the workbench is in its folded condition and, so that said step tread is pivoted into a substantially horizontal position transverse to said last-mentioned legs when the workbench is in said erected condition.

10. A portable, foldable workbench comprising:

a support structure defining surface support means;

a first elongate bench board having an upper surface and being supported by said supporting structure on said surface support means;

a second elongate bench board adjacent said first elongate bench board and having an upper surface, said upper surfaces lying in a common substantially horizontal plane; and, clamping means associated with one of said bench boards for clamping a workpiece;

said support structure including two leg assemblies supporting said bench-top arrangement at respective longitudinal ends thereof, each of said leg assemblies including:

first and second legs pivotally connected to said bench-top arrangement so as to be pivotally movable from a collapsed position wherein the workbench is in a folded condition to an open position wherein said legs diverge from one another in a downward direction and the workbench is in said erection condition;

said first and second legs being pivotally connected to said bench-top arrangement at first and second pivot axes, respectively; said first pivot axis being at a lower elevation than said second pivot axis when the workbench is viewed in the erected condition in end elevation whereby said bench-top arrangement, said first leg, and said second leg are all juxtaposed one to the other to form a flat stack of mutually parallel elements when the workbench is in the folded condition;

a linkage arrangement for fixing the spread between said legs to a predetermined distance when said legs are in said open position;

said first pivot axes of each of said assemblies being coaxial, a brace connecting said first legs of said leg assemblies to conjointly define therewith a first rigid H-frame pivotally mounted to said bench-top arrangement for pivoting about the common axis defined by said first pivot axes; and, said second pivot axes of each of said assemblies being coaxial, a brace connecting said second legs of said leg assemblies to conjointly define therewith a second rigid H-frame pivotally mounted to said bench-top arrangement for pivoting about the common axis defined by said second pivot axes.

11. A portable, foldable workbench comprising:

a bench-top arrangement including two elongate bench boards having respective upper surfaces lying in a common plane;

a support structure for supporting said bench-top arrangement above the ground when the workbench is in the erected condition, said support structure including two leg assemblies supporting said bench-top arrangement at respective longitudinal ends thereof, each of said leg assemblies including:

first and second legs pivotally connected to said bench-top arrangement so as to be pivotally movable from a collapsed position wherein the workbench is in a folded condition to an open position wherein said legs diverge from one another in a downward direction when the workbench is in said erected condition;

said first and second legs being pivotally connected to said bench-top arrangement at first and second pivot axes, respectively; said first pivot axis being at a lower elevation than said second pivot axis when the workbench is viewed in the erected condition in end elevation so as to enable said bench-top arrangement, said first leg, and said second leg to be all juxtaposed one to the other to form a flat stack of mutually parallel elements when the workbench is in the folded condition;

a linkage arrangement for fixing the spread between said legs to a predetermined distance when said legs are in said open position; and such linkage arrangement including a link means extending between the first and second legs and being connected thereto at respective first and second attachment points which are spaced along the associated legs from the first and second pivot axes respectively, the link means being adapted to allow the distance between the first and second attachment points to be varied from a maximum distance as when the first and second legs are in the open condition to a minimum distance as when such legs are in the folded condition;

and ancillary means for coacting between one of said first and second legs and said bench top arrangement in a region which is spaced from the pivot axis between such leg and the bench top arrangement to position the latter relative to said legs when the workbench is in the erected condition.

12. The portable, foldable workbench of claim 11, said first leg being shorter than said second leg by an amount sufficient to ensure that said bench-top arrangement will be in a substantially horizontal position when the workbench is in said erected condition.

13. The portable, foldable workbench of claim 11, comprising means defining a plurality of substantially cylindrical bores opening through the upper surface of each of said bench boards.

14. The portable, foldable workbench of claim 13, comprising:

at least two abutment means receivable in respective cylindrical bores of corresponding ones of said bench boards; and means for moving one of said abutment means with respect to the other one of said abutment means to grip a workpiece therebetween.

15. The portable, foldable workbench of claim 11, 12 or 13 comprising a step tread extending from a leg of one of said leg assemblies to a leg of the other one of said leg assemblies.

16. The portable, foldable workbench of claim 11, 12 or 13 comprising:

said first pivot axes of each of said assemblies being coaxial, a brace connecting said first legs of said leg assemblies to conjointly define therewith a first rigid H-frame pivotally mounted to said bench-top arrangement for pivoting about the common axis defined by said first pivot axes; and said second pivot axes of each of said assemblies being coaxial;

a brace connecting said second legs of said leg assemblies to conjointly define therewith a second rigid H-frame pivotally mounted to said bench-top arrangement for pivoting about the common axis defined by said second pivot axes.

17. The workbench of claim 11, 12 or 13 wherein said bench boards are mutually spaced to conjointly define a longitudinal slot therebetween.

* * * * *